United States Patent [19]

Omo, Jr.

[11] Patent Number: 4,542,674

[45] Date of Patent: Sep. 24, 1985

[54] ALIGNMENT DEVICE AND DIE ADJUSTMENT APPARATUS FOR PUNCH PRESSES AND THE LIKE

[75] Inventor: RB Omo, Jr., Bath, Me.

[73] Assignee: Bath Iron Works Corporation, Bath, Me.

[21] Appl. No.: 520,011

[22] Filed: Aug. 3, 1983

[51] Int. Cl.[4] ..... B26F 1/02

[52] U.S. Cl. ..... 83/527; 83/698; 83/859; 100/214; 100/257; 100/282; 72/455

[58] Field of Search ..... 83/527, 630, 698, 859; 72/451, 455, 456; 403/14; 100/214, 257, 281, 282

[56] References Cited

U.S. PATENT DOCUMENTS

| | | | |
|---|---|---|---|
| 1,945,282 | 1/1934 | Lindgren | 100/282 X |
| 2,081,175 | 5/1937 | Friden | 83/527 X |
| 2,320,103 | 5/1943 | Seidel et al. | 100/257 X |
| 2,910,898 | 11/1959 | Martindell | 72/451 X |
| 3,124,019 | 3/1964 | Chatfield | 72/456 X |
| 4,017,267 | 4/1977 | Hawley | 83/698 X |

FOREIGN PATENT DOCUMENTS

| | | | |
|---|---|---|---|
| 2208411 | 8/1973 | Fed. Rep. of Germany | 100/214 |

*Primary Examiner*—James M. Meister

*Attorney, Agent, or Firm*—Shlesinger Arkwright Garvey & Fado

[57] ABSTRACT

An alignment mechanism for punch presses and the like, comprising a base having an upper support surface; the upper support surface having a plurality of load oriented spaced shaped recesses; a base alignment sleeve positioned in each of the recesses and conforming thereto and extending upwardly above the upper support surface; a frame positioned on the upper support surface and having a portion extending upwardly therefrom; the frame having a first set of a plurality of load oriented spaced shaped recesses for cooperating with the plurality of base recesses for positioning the alignment sleeves in the first set of recesses for aligning the frame with the base; the upwardly extending portion of the frame having an uppermost surface; the uppermost surface having a second set of a plurality of load oriented spaced shaped recesses; a crown alignment sleeve positioned in each recess of the second set of recesses and conforming thereto and extending upwardly above the upper row surface; a crown positioned on the uppermost surface; and, the crown having a plurality of load oriented spaced shaped recesses for positioning the alignment sleeves of the second set of recesses in the crown recesses for aligning the crown with the frame is disclosed herewith.

22 Claims, 14 Drawing Figures

ALIGNMENT DEVICE AND DIE ADJUSTMENT APPARATUS FOR PUNCH PRESSES AND THE LIKE

BACKGROUND OF THE INVENTION

Punch presses are comprised, generally, of a ground supported base, a frame positioned on the base, and a crown positioned atop the frame. A set of dies are mounted to the frame and are used to produce the desired, usually, metal product. The die set includes a male and a female die. Due to the high forming forces necessary, it is critical that the frame and crown be accurately aligned with the base so as not to damage the dies or cause the press to fail. An additional problem is that the repeated use of the dies causes die wear which may result in parts which are not conforming to the desired specification.

In view of the above, a new and unique means for aligning a punch press frame and crown atop a punch press bed and a means for compensating for die wear is necessary.

Previous punch press alignment mechanisms have involved the use of keys positioned between the various members to be aligned. The accurate positioning of such keys was costly and time consuming.

Additionally, shims have been used to adjust for die wear but no such similar means was provided whch accurately remotely adjusted the dies.

Additionally, removeable shims were used to adjust for die wear, but no automatic shimming means has been available.

OBJECTS AND SUMMARY OF THE INVENTION

It is a primary object of the disclosed invention to provide an alignment mechanism which is capable of achieving highly accurate alignment of a punch press frame and crown atop a punch press base or bed.

It is an additional object of the disclosed invention to provide a punch press alignment mechanism which may be pre-fabricated at the time of manufacture of the press and which may be installed quickly and easily.

It is a further object of the disclosed invention to provide an alignment mechanism which permits accurate repeatable adjustment of the wedge adjustment mechanism to compensate for die wear.

Still another object of the disclosed invention is to provide an alignment mechanism which is adapted for cooperating with the punch press tie rods.

Yet a further object of the disclosed invention is to provide an alignment mechanism which uniformly distributes the load generated by the press and which has maximum resistance to deformation.

Yet still a further object of the disclosed invention is to provide an alignment mechanism which achieves high accuracy alignment while requiring less machining and less assembly labor than previous alignment mechanisms.

Yet an additional object of the disclosed invention is to provide a wedge mechanism for adjusting the dies of the punch press to accomodate die wear.

Yet a further object of the disclosed invention is to provide a wedge adjustment mechanism which may be remotely operated.

Still yet a further object of the disclosed invention is to provide a wedge adjustment mechanism which indicates the amount adjusted so as to be operated by relatively unskilled labor.

Yet still a further object of the disclosed invention is to provide a wedge adjustment mechanism which requires less machining during assembly.

These and other objects and advantages of the invention will be readily apparent in view of the following description and drawings of the above described invention.

DESCRIPTION OF THE DRAWINGS

The above and other objects and advantages and novel features of the present invention will become apparent from the following detailed description of the preferred embodiment of the invention illustrated in the accompanying drawings, wherein.

DESCRIPTION OF THE INVENTION

Figure 1:
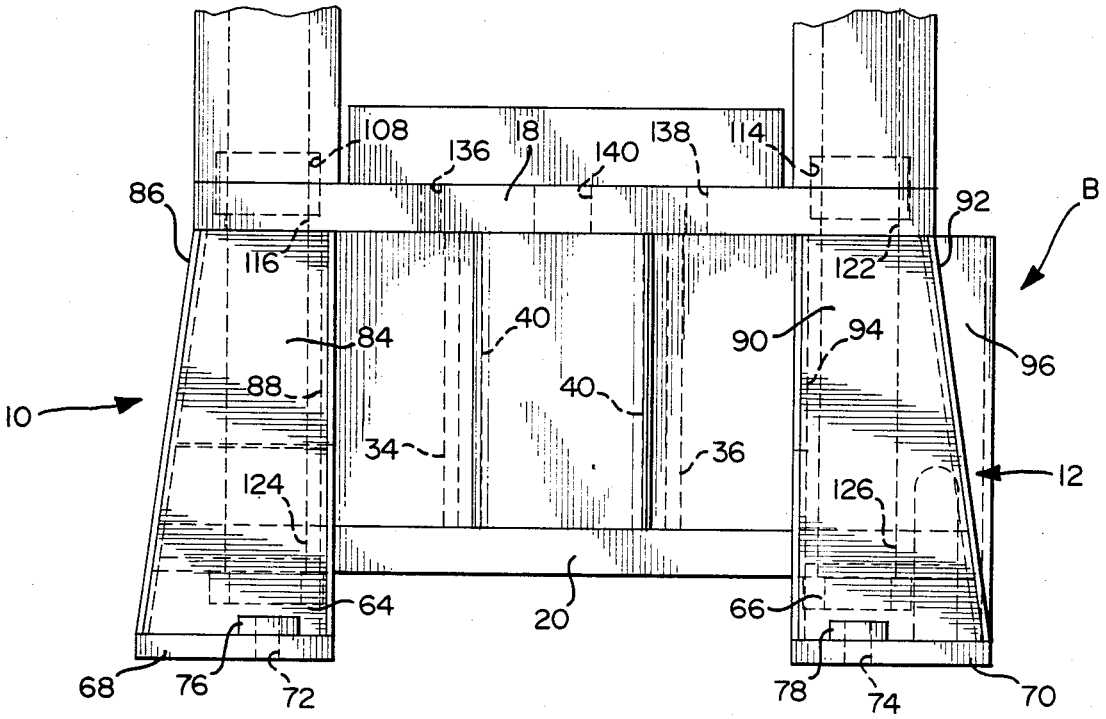
FIG. 1 is a fragmentary front elevation view with portions shown in phantom of a punch press base or bed and disclosing the press frame.
Figure 2:
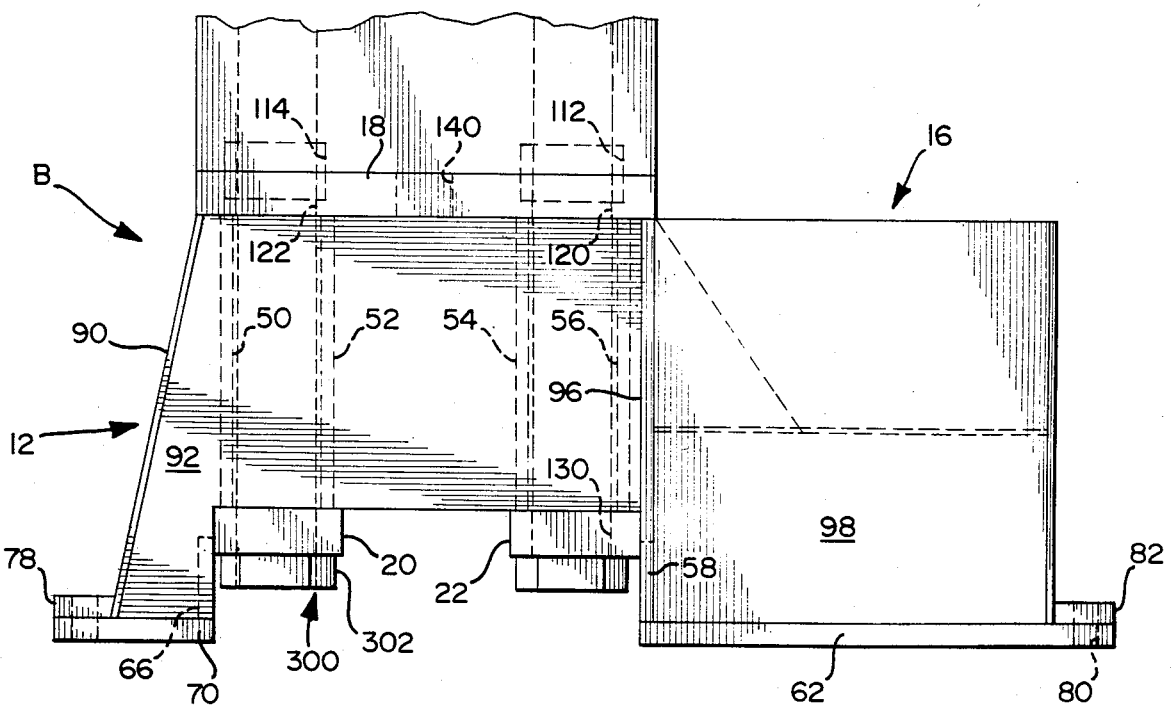
FIG. 2 is a fragmentary right side elevational view of the punch press bed of FIG. 1 with portions shown in phantom and disclosing the press frame.
Figure 6:
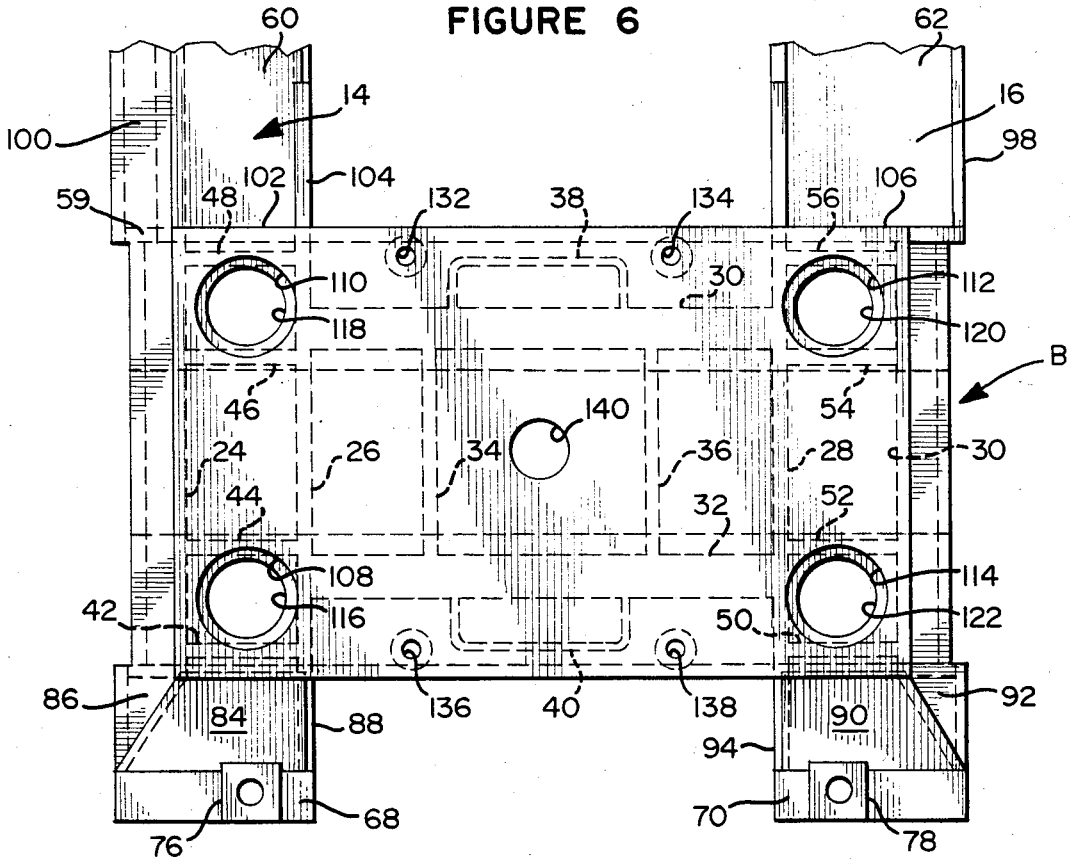
FIG. 6 is a fragmentary top plan view of the punch press bed of FIG. 1 with portions shown in phantom.

A punch press base or bed B, as best shown in FIGS. 1, 2, and 6, is a ground supported structure to which the punch press components are secured. Bed B has front pedestals 10 and 12, as best shown in FIG. 1, and rear air and lubrication housings 14 and 16, respectively, as best shown in FIG. 6. Bed B includes top plate 18 and spaced parallel bottom plates 20 and 22, as best shown in FIG. 2, which are spaced from and parallel to top plate 18. In FIG. 6 stiffeners 24 and 26 extend vertically and horizontally between pedestal 10 and air housing 14 and are secured thereto by welding or other means. Stiffeners 28 and 30 extend horizontally and vertically between pedestal 12 and oil housing 16 and are secured thereto by welding or other fastening means. Stiffeners 24, 26, 28, and 30 span the distance from top plate 18 to bottom plates 20 and 22 and are secured by welding or other fastening means. Main plates 30 and 32 are disposed in spaced parallel relationship and extend between stiffeners 26 and 28 and are secured by welding or other similar fastening means. Main plate 30 spans the distance from bottom plate 22 to top plate 18 and main plate 32 spans the distance between bottom plate 20 and top plate 18. Stiffeners 34 and 36 are disposed in spaced parallel relationship between main plates 30 and 32. Generally U-shaped supports 38 and 40 are fastened to main plates 30 and 32, respectively, and extend between bottom plate 22 and top plate 30 and bottom plate 20 and top plate 18, respectively.

In FIG. 6, box stiffeners 42 and 44 extend between stiffeners 24 and 26 and bottom plate 20 and top plate 18. Box stiffeners 46 and 48 extend between stiffeners 24 and 26 and bottom plate 22 and top plate 18. Box stiffeners 50 and 52 extend between stiffeners 28 and 30 and bottom plate 20 and top plate 18. Box stiffeners 54 and 56 extend between stiffeners 28 and 30 and bottom plate 22 and top plate 18.

As best shown in FIG. 6 and FIG. 2, bottom support plate 58 is fastened to bottom plate 22 and encloses the housing 16. Bottom support 59 closes housing 14 and is secured to plate 22. Supports 58 and 59 are connected to ground engaging plates 60 and 62 of housings 14 and 16, respectively. In FIG. 1 front plates 64 and 66 are connected to bottom plate 20 and to ground engaging plates 68 and 70. Ground engaging plates 68 and 70 are maintained in parallel co-planar relationship with ground engaging plates 60 and 62. Ground engaging plates 68 and 70 contain apertures 72 and 74, respectively adapted for receipt of a bolt (not shown) for securing bed B to the ground or the surface to which it is to be supported. Additionally, lock nuts 76 and 78 may be co-axially mounted on apertures 72 and 74, respectively, so to permit receipt of a threaded lock bolt (not shown). Ground engaging plate 62 has threaded aperture 80 and co-axially mounted lock nut 82 for receipt of a lock bolt (not shown). Ground engaging plate 60 contains a similar aperture and lock nut arrangement (not shown).

Pedestal 10, as best shown in FIG. 1, includes angularly disposed front plate 84 extending from ground engaging plate 68 to top plate 18 and angularly disposed side plate 86 extending between ground engaging plate 68 and top plate 18. Vertically extending side plate 88 extends from ground engaging plate 68 to top plate 18.

Pedestal 12, as best shown in FIGS. 1 and 2, includes angularly disposed front plate 90 and angularly disposed side plate 92 both extending from ground engaging plate 70 to top plate 18. Vertically extending side plate 94 extends from ground engaging plate 70 to top plate 18.

Housing 16 includes front plate 96 extending from stiffener 30 and side plate 98 extending transversely therefrom and secured to ground engaging plate 62. In FIG. 6 housing 14 includes angularly disposed side plate 100 secured to stiffener 102 and vertical side plate 104. Stiffener 106 is connected to front plate 96 and is maintained parallel to box member 56.

Top plate 18, as best shown in FIG. 6, includes cylindrical recesses 108, 110, 112, and 114. Apertures 116, 118, 120, and 122 have equal diameter and are co-axial with recesses 108, 110, 112, and 114, respectively, and the diameter of apertures 116, 118, 120, and 122 is less than the diameter of recesses 108, 110, 112, and 114. Bottom plate 20, as best shown in FIG. 1, has apertures 124 and 126 co-axial with apertures 116 and 122 and, preferably, having a diameter equal to the diameter of apertures 116 and 122. Bottom plate 122 has apertures similar to apertures 124 and 126, although only aperture 130 is visible in FIG. 2. The left aperture is not shown and is co-axial with aperture 118, and, has a diameter equal to the diameter of aperture 118.

Top plate 18, as best shown in FIG. 6, contains flared apertures 132, 134, 136, and 138. Additionally, top plate 18 includes aperture 140. Bottom support 58 and front plate 96 contain slot 142, as best shown in FIG. 1, used to access the oil reservoir apparatus contained in housing 16.

Figure 3:
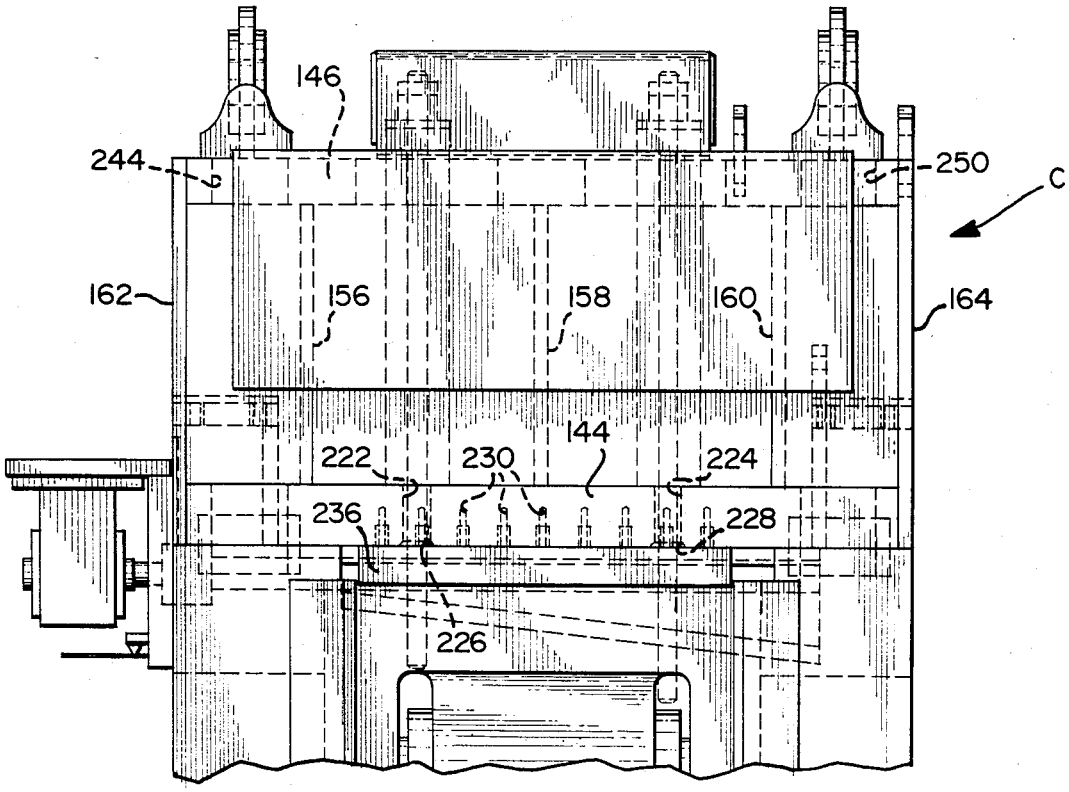
FIG. 3 is a fragmentary front elevational view with portions shown in phantom of a punch press crown and disclosing the press frame.
Figure 4:
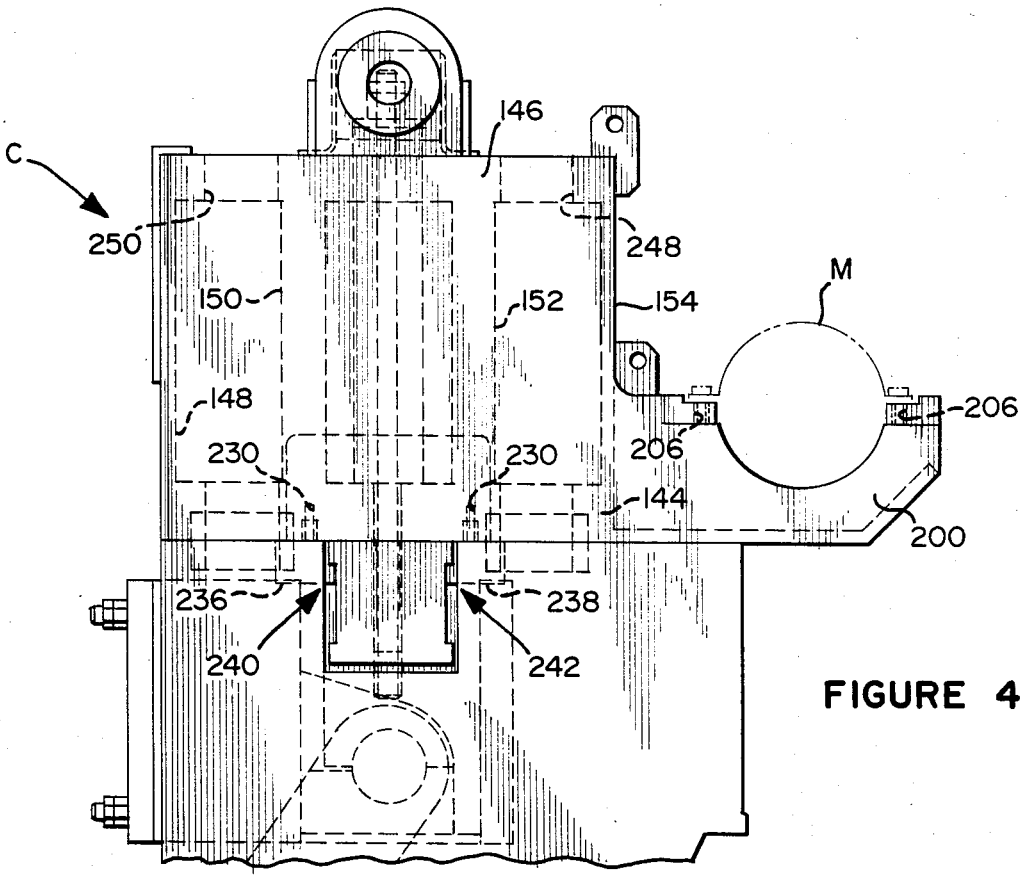
FIG. 4 is a fragmentary side elevational view with portions shown in phantom of a punch press crown of FIG. 3 and disclosing the press frame.
Figure 5:
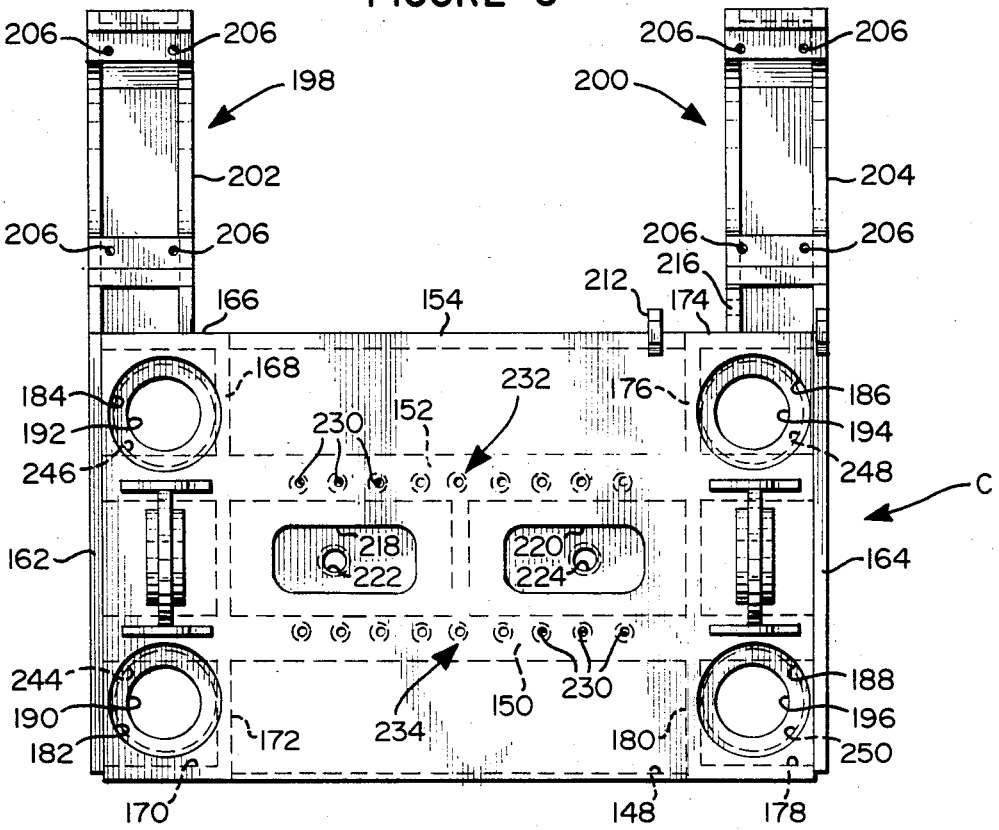
FIG. 5 is a top plan view with portions shown in phantom of the crown of FIG. 3.

A punch press crown C as best shown in FIGS. 3–5 includes bottom plate 144 and spaced parallel top plate 146. Front plate 148 extends between top plate 146 and bottom plate 144 and stiffeners 150 and 152 are maintained in a spaced parallel relationship and extend from top plate 146 to bottom plate 144 and are parallel to top plate 148. Rear plate 154 extends from bottom plate 144 to top plate 146 and is parallel to front plate 148. Stiffeners 156, 158, and 160 are secured between top plate 146 and bottom plate 144. Spaced parallel side plates 162 and 164 extend between front plate 148 and rear plate 154.

Box stiffener 166, as best shown in FIG. 5, is secured to side plate 162 and bottom plate 144 and box stiffener 168 is secured to stiffener 166, stiffener 152 and bottom plate 144. Box stiffener 170 is secured to bottom plate 144 and side plate 162 and box stiffener 172 is secured to stiffener 172, stiffener 150 and bottom plate 144. Box stiffener 174 is connected to side wall 164 and bottom plate 144 and stiffener 176 is connected to stiffener 174, stiffener 172 and bottom plate 144. Box stiffener 178 is connected to side walls 164 and bottom plate 144 and stiffener 180 is connected to stiffener 178, stiffener 150 and bottom plate 144.

Cylindrical recesses 182, 184, 186, and 188 are machined into bottom plate 144 and have equal diameter and are co-axial with recesses 108, 110, 112 and 114 of bed B. Recesses 182, 184, 186, and 188 have co-axial apertures 190, 192, 194, and 196, respectively, which are likewise co-axial with apertures 116, 118, 120, and 122. Apertures 190, 192, 194, and 196 have equal diameters and have a diameter less than the diameter of recesses 182, 184, 186, and 188 and, preferably, equal to the diameter of apertures 116, 118, 120, and 122. Preferably, recesses 182, 184, 186, and 188 have a diameter equal to the diameter of recesses 108, 110, 112, and 114.

Cradle 198 is connected to sidewall 162 and stiffener 166 and cradle 200 is connected to side wall 164 and stiffener 174. Cradles 198 and 200 have semi-circular apetures or grooves 202 and 204, respectively, for holding the drive motor of the press. Cradles 198 and 200 also contain a plurality of threaded apertures 206 to assist in securing drive motor M.

Preferably, top plate 146 will have lifting lugs 208 and 210 affixed thereto. Top plate 146 also includes brackets 212 and 214. Cradles 198 and 200 include brackets 216.

Top plate 146 includes generally rectangular apertures 218 and 220. Bottom plate 144 include apertures 222 and 224, respectively. Apertures 222 and 224 are, preferably, flared at the lower surface of bottom plate 144, as at 226 and 228.

Bottom plate 144 includes a plurality of threaded bores 230 extending upwardly from the bottom surface of bottom plate 144. Threaded bores 230 are disposed in two rows of bores 232 and 234 and the rows 232 and 234 are disposed in spaced parallel relationship. Opposed spaced parallel wedge gibs 236 and 238, as best shown in FIG. 4, are fastened to the underside of bottom plate 144 by threaded bolts (not shown) to the bores 230 of rows 234 and 232, respectively. Wedge gib 236 has a shoulder 240 and wedge gib 238 has a shoulder 242.

Top plate 146, as best shown in FIG. 5, has apertures 244, 246, 248 and 250 co-axial with apertures 190, 192, 194, and 196 and apertures 244, 246, 248, and 250 have equal diameters which are less than the diameter of apertures 190, 192, 194, and 196.

Figure 7:
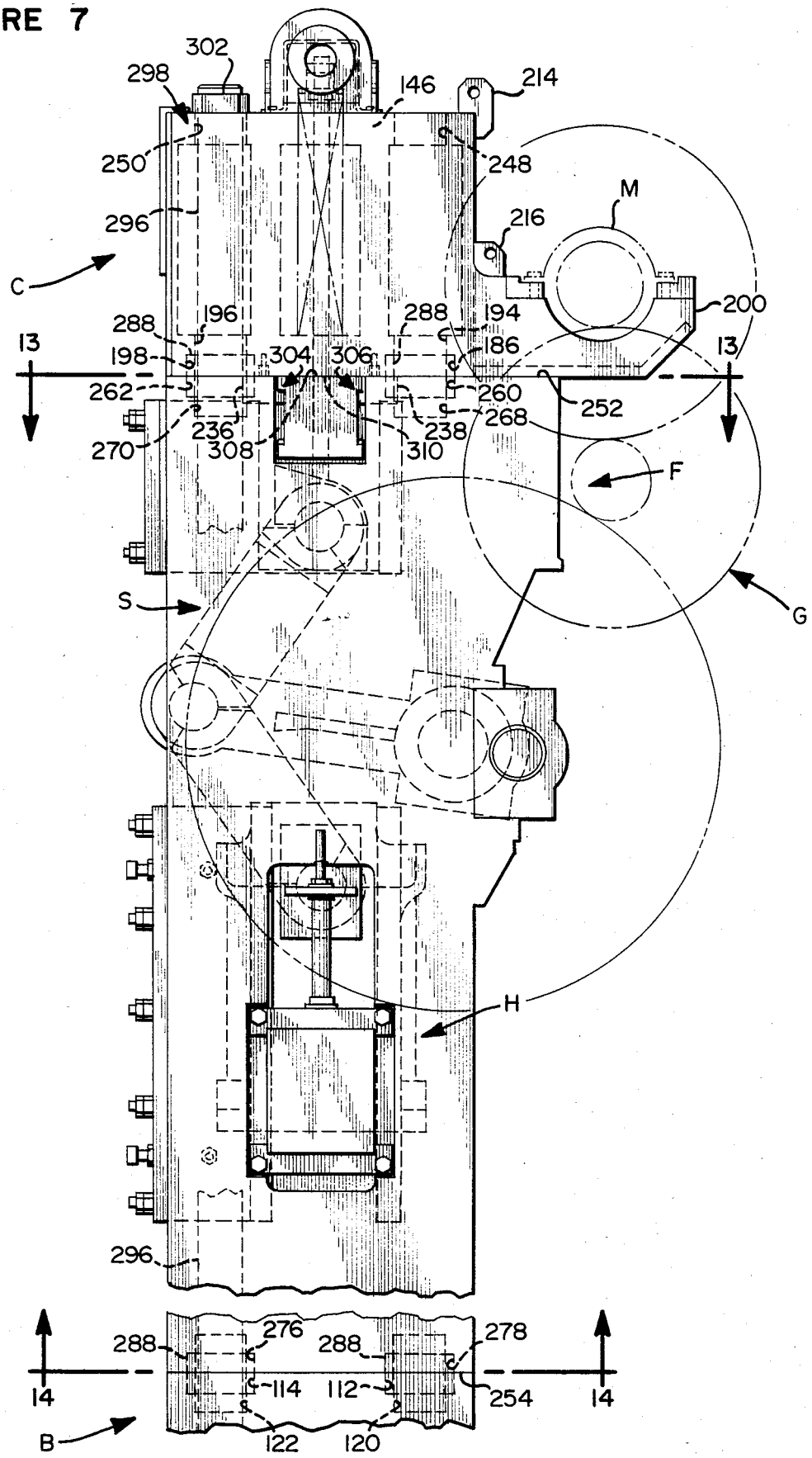
FIG. 7 is a fragmentary side elevational view with broken lines indicating indefinite length of an assembled punch press.
Figure 8:
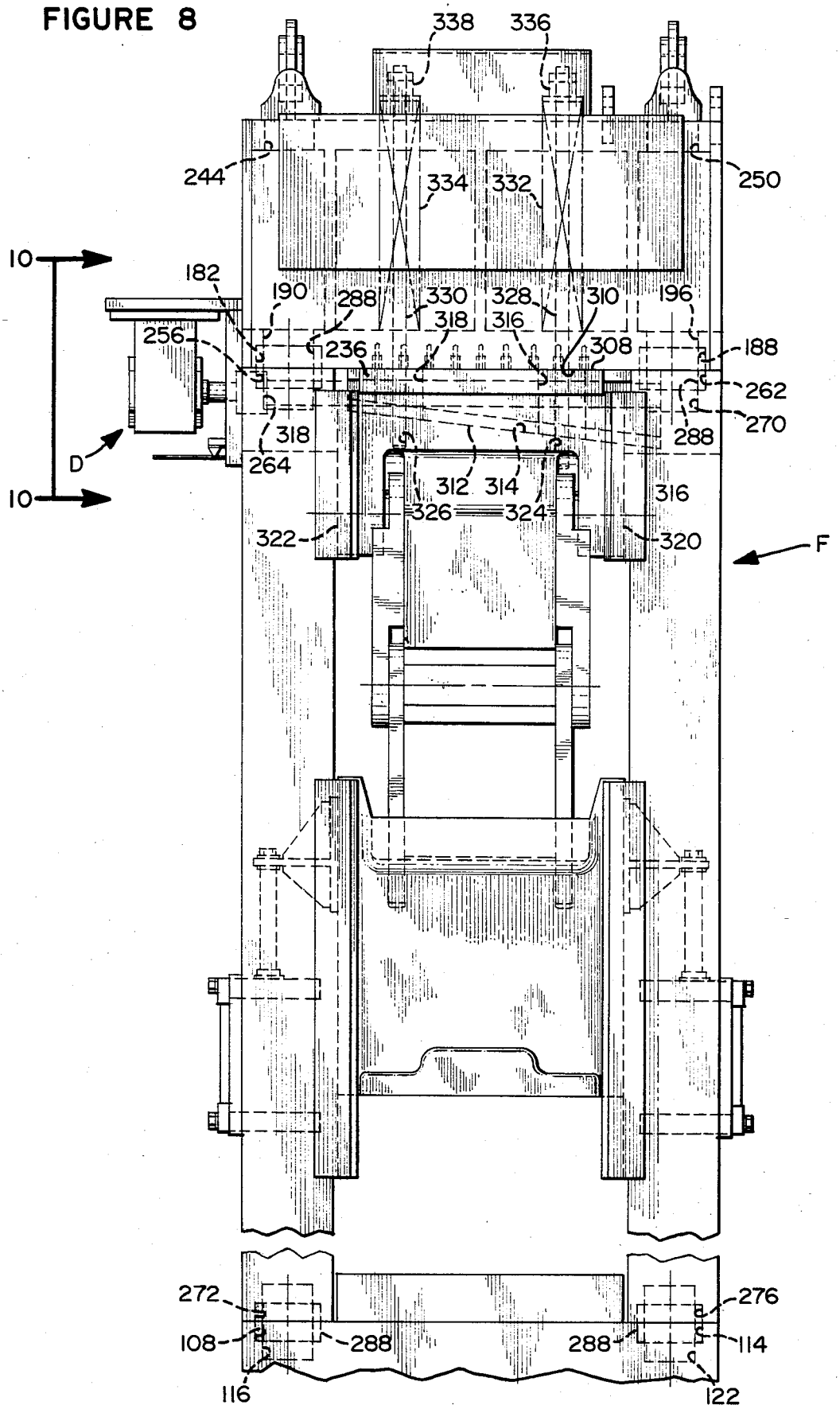
FIG. 8 is a fragmentary front elevational view with broken lines indicating indeterminate length of the punch press of FIG. 7.
Figure 13:
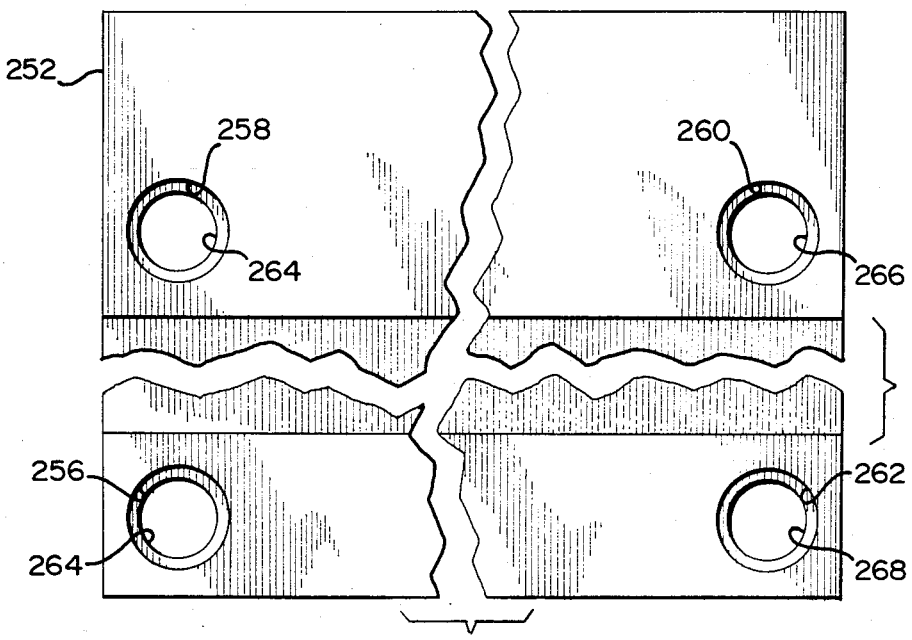
FIG. 13 is a cross-sectional view with broken lines indicating indeterminate length taken along the section 13—13 of FIG. 7 and viewed in the direction of the arrows; and, FIG. 14 is a cross-sectional view with broken lines indicating indeterminate length taken along the section 14—14 of FIG. 7 and viewed in the direction of the arrows.
Figure 14:
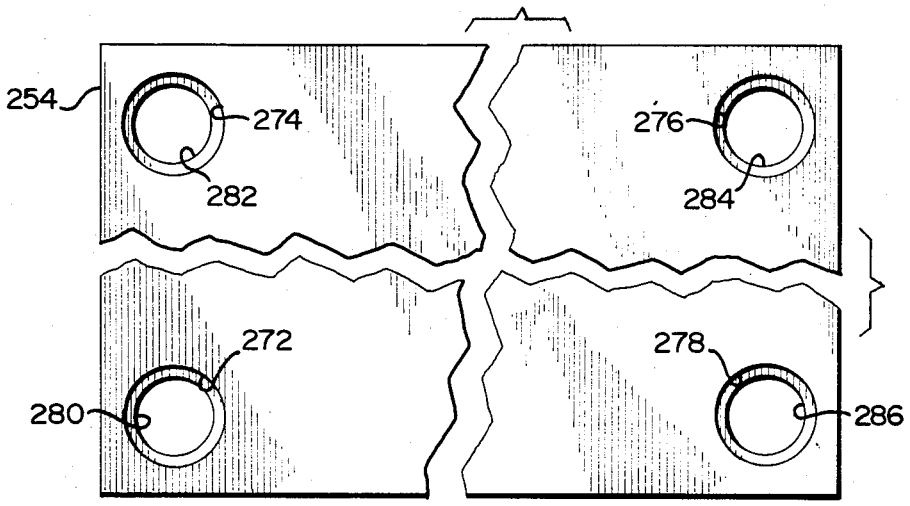

A generally rectangular frame F, as best shown in FIGS. 7 and 8, is disposed between crown C and bed B. Frame F has an upper flat surface 252 and a lower flat surface 254 spaced from and parallel to surface 252. Surface 252, as best shown in FIG. 13, includes cylindrical recesses 256, 258, 260 and 262 co-axial with recesses 182, 184, 186, and 188 and machined into surface 252. Apertures 264, 266, 268, and 270 are co-axial with recesses 256, 258, 260, and 262 and have substantially the same diameter as apertures 190, 192, 194, and 196. Bottom surface 254, as best shown in FIG. 14, includes recesses 272, 274, 276, and 278 having a diameter equal to and co-axial with recesses 108, 110, 112, and 114. Recesses 272, 274, 276, and 278 have co-axial apertures 280, 282, 284, and 286 with diameters with equal to the diameter of apertures 264, 266, 268, and 272.

Figure 11:
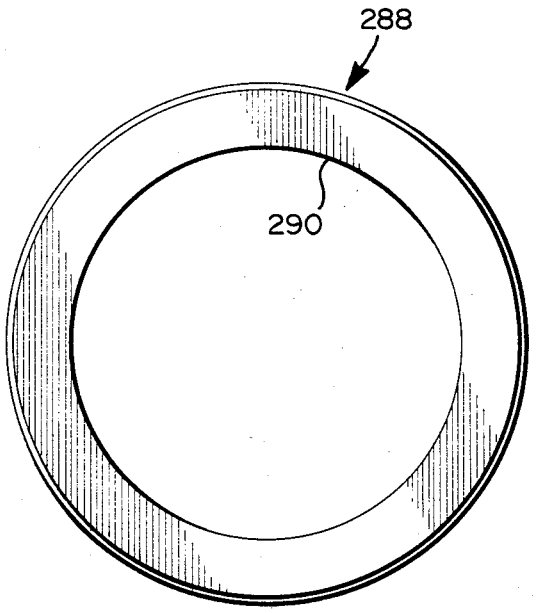
FIG. 11 is a top plan view of an alignment sleeve used with the invention.
Figure 12:
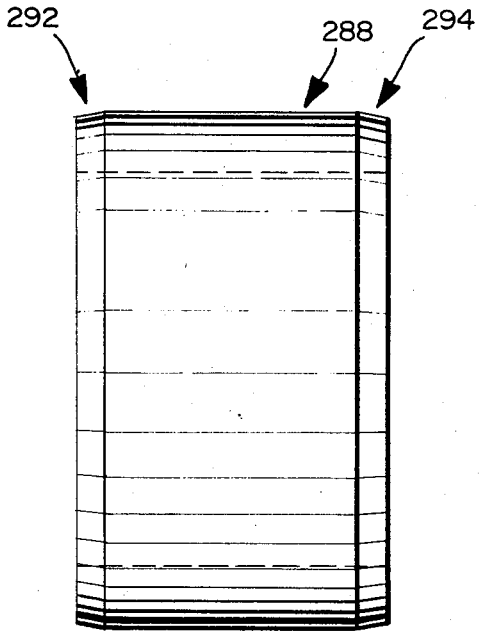
FIG. 12 is a front side elevational view of the sleeve of FIG. 11.

A generally cylindrical alignment sleeve 288, as best shown in FIGS. 11 and 12, has an aperture 290 and tapered ends 292 and 294. Aperture 290 has a diameter corresponding to the diameter of apertures 116, 118, 120, 122, 190, 192, 194, 196, and sleeve 288 has an external diameter sized to be substantially equal to the diameter of recesses 108, 110, 112, 114, 182, 184, 186, and 188. Aperture 190 diameter is also sized to be substantially equal to the diameter of apertures 264, 266, 268, 270, 280, 282, 284, and 286. Alignment sleeve 288 has an external diameter sized to be substantially equal to the diameter of recesses 256, 258, 260, 262, 272, 274, 276, and 278.

In assembling the punch press or other similar machine, an alignment sleeve 288, as best shown in FIGS. 7 and 8, is placed in each one of recesses 108, 110, 112, and 114. Alignment sleeve 288 is sized to substantially span the recesses 108, 110, 112, and 114 and the alignment sleeve 288 extends a substantial distance above top plate 18 of bed B. Frame F may be precisely and accurately aligned to be positioned on top plate 18 and alignment sleeves 288 extend upwardly above top plate 18 and engage cooperating recesses 272, 274, 276, and 278. The external diameter of alignment sleeve 288 is sized to substantially span recesses 272, 274, 276, and 278 and frame F may be accurately aligned atop bed B because tapered ends 292 and 294 guide the insertion of sleeve 288 as well as the positioning of frame F on bed B. An alignment sleeve 288 is then placed in each of recesses 256, 258, 260, and 262 and substantially span recesses 256, 258, 260, and 262. Sleeves 288 are positioned in recesses 256, 258, 260, and 262 and extend a substantial distance above upper surface 252 of frame F. Crown C may be highly accurately aligned atop frame F as the alignment sleeve 288, with tapered ends 290 and 292, of recesses 256, 258, 260, and 262 engage recesses 182, 184, 186, and 188 of crown C and the alignment sleeve 288 substantially span the diameter of recesses 182, 184, 186, and 188. Consequently, crown C may be highly accurately positioned atop frame F which has been highly accurately positioned atop a bed B of a punch press. Because all of the recess 108, 110, 112, 114, 182, 184, 186, 188, 256, 258, 260, 262, 272, 274, 276 and 278 are machined into their respective surfaces, they may be positioned with extreme accuracy to therefore achieve the extremely high level of alignment necessary.

Preferentially, a tie rod 296 having an upper threaded end 298 and a lower threaded end 300 will extend downwardly through each of apertures 244, 246, 248, and 250 and through apertures 290 of each alignment sleeve 288 and extend through apertures 128, 129, 130, and 131. Lock nuts 302 will be placed upon the upper and lower threaded ends 298 and 300, respectively, of each tie rod 296. Lock nuts 302 will be sized to have a diameter greater than the diameter of apertures 128, 129, 130, 131, and greater than the diameter of apertures 244, 246, 248, and 250 so that lock nuts 302 will not be pulled through those apertures, and, consequently, the crown C will be firmly affixed atop frame F and frame F will stay firmly affixed atop bed B and the tie rods 296 therefore serve to help maintain the overall stability of the punch press.

A conventional punch press stamping linking mechanism S is displaceably mounted in frame F and is adapted for longitudinally displacing die means H as much as 0.50 inches by means of a wedge W. Wedge W is adapted to longitudinally displace stamping linkage mechanism S by approximately 0.03 inches for every 0.25 inches of lateral displacement of wedge W. Wedge W has shoulders 304 and 306, as best shown in FIG. 7, for cooperating with shoulders 240 and 242, respectively, of wedge gibs 236 and 238, respectively. Shoulders 304 and 306 are slideably mounted on and bear again shoulders 240 and 242. Wedge W has an upper surface 308 which presses against lower surface 310 of crown C. As best shown in FIG. 8, wedge W has a lower sloped surface 312 which bears against lower sloped surface 314 in frame F.

Wedge W contains laterally extending co-planar cooperating slots 316 and 318, as best shown in FIG. 8. Stamping linkage apparatus S is slideably mounted in frame F and is guided by cooperating longitudinally extending gibs 320 and 322 and contains threaded bores 324 and 326. Longitudinally extending studs 328 and 330 engage threaded bores 324 and 326, respectively, and extend upwardly through apertures 222 and 224 in bottom plate 144 of crown C and extend further upwardly through apertures 218 and 220 in top plate 146 of crown C. Coil springs 332 and 334 are co-annularly mounted around studs 328 and 330, respectively, and bear against the upper surface of bottom plate 144 and extend upwardly through recesses 218 and 220. Coil springs 332 and 334 are secured to studs 328 and 330, respectively, by nuts 336 and 338 secured to studs 328 and 330. Coil springs 332 and 334 act as shock absorbers to absorb the shock caused by the operation of stamping apparatus S and serve also to keep lower surface 314 of stamping apparatus S pressed firmly against lower surface 312 of wedge W. Studs 328 and 330 pass through slots 316 and 318 in wedge W and serve to guide wedge W as it is laterally displaced in either direction. Slots 316 and 318, preferably, each have a length of approximately 4 inches.

As wedge W is laterally displaced through gap or recess 340, of which sloped surface 314 forms the bottom portion, wedge W presses against sloped surface 314 which, consequently, compresses springs 332 and 334 and longitudinally displaces stamping apparatus S. In this way, the wedge W adjusts stamping linkage apparatus S so as to adjust die means H to accomodate die wear and also to precisely adjust stamping linkage apparatus S. As wedge W progresses through recess 340, the distance from sloped surface 314 at any one point to the lower surface 310 of crown C must increase as upper surface 308 presess firmly against surface 310 while lower surface 312 presses firmly against surface 314.

The gearing which drives stamping linkage S and operates die means H is connected to motor M and is shown in phantom in FIG. 7.

Figure 9:
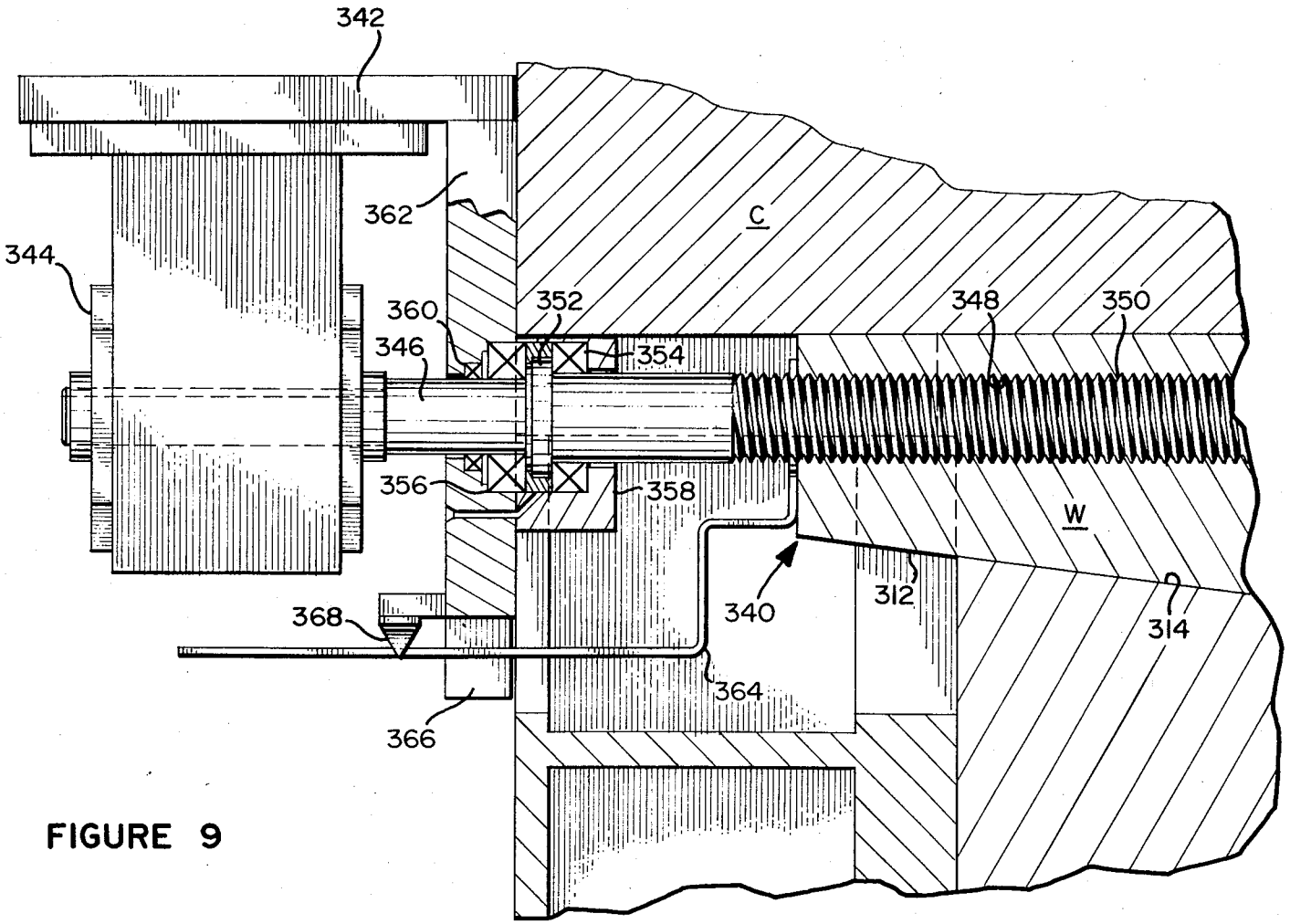
FIG. 9 is an enlarged fragmentary cross-sectional view taken along the section 9—9 of FIG. 10 and disclosing the wedge adjustment means.
Figure 10:
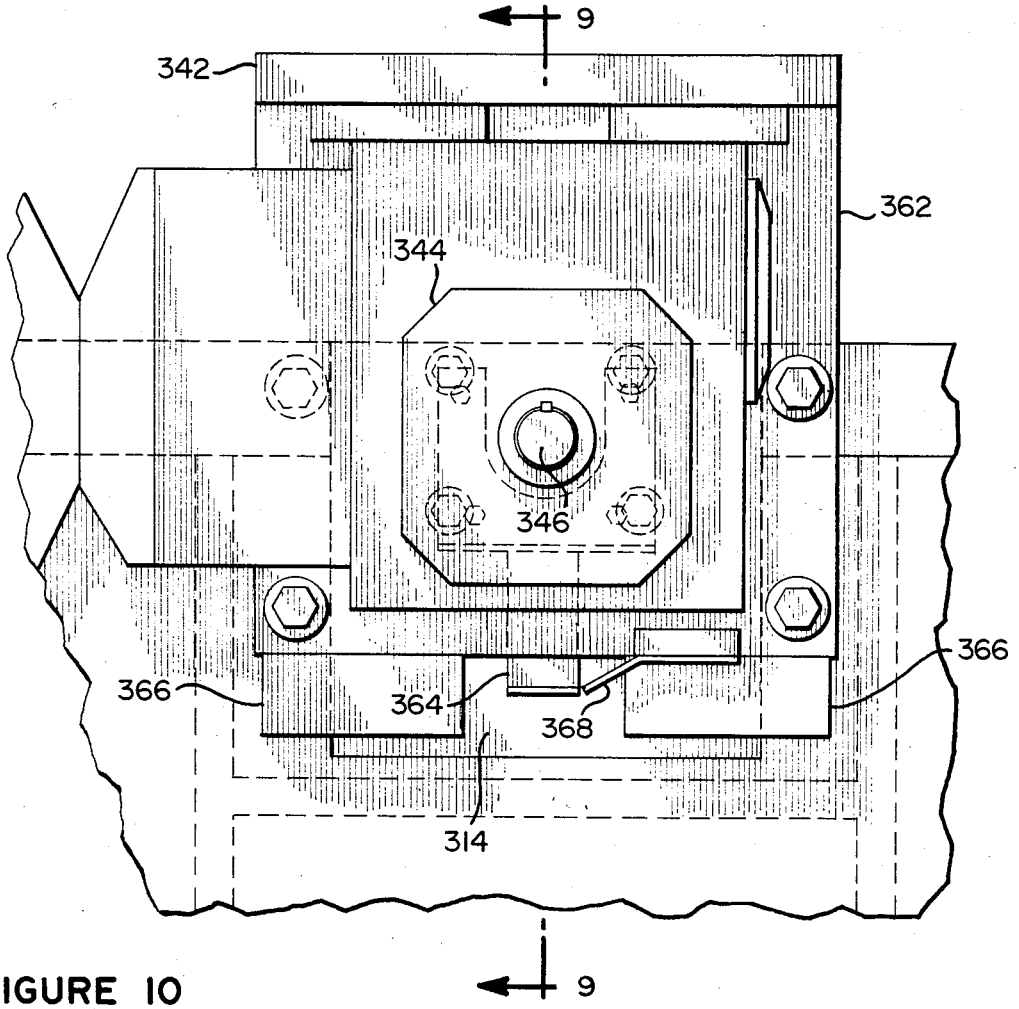
FIG. 10 is a fragmentary side elevational view taken along the section 10—10 of FIG. 8 and disclosing the wedge adjustment means.

A wedge displacement mechanism D, as best shown in FIG. 9, has mounting bracket 342 secured to crown C and has electrical motor means 344 affixed thereto. Motor 344 has a laterally extending rotatable shaft 346 which is co-axial with threaded insert 348 laterally extending in wedge W. Shaft 346 has a threaded portion 350 which engages threaded insert 348 of wedge W. Shaft 346 has an annular shoulder 352 mounted between bearings 354 and 356. Bearings 354 and 356 are maintained in position by plate bearing bracket 358 which prevents bearings 354 and 356 from being laterally displaced. A seal 360 is annularly mounted around shaft 346 adjacent bearing 356. Housing 362 is mounted around shaft 346 and presses against seal 360 and bearing 356 to prevent lateral displacement of shaft 346. In this way, shaft 346 and threaded portion 350 are free to rotate but are not free to be laterally displaced and, consequently, rotation of shaft 346 causes threaded portion 350 to engage threaded insert 348 and the rotation causes wedge W to be laterally displaced either forward or backwards depending upon the direction of rotation of shaft 346.

A limit switch bar 346 is connected to wedge W and passes through limit switch 366 so that the position of wedge W in gap or recess 340 may be monitored. A pointer 368 may be mounted to housing 362 and bar 364 and may contain markings so that the operator may determine the position of wedge W without the need of limit switch 366.

In this way, the stamping linkage mechanism S may be repeatably positioned to accomodate die means H because crown C and frame F are accurately maintained in horizontal and vertical alignment by means of sleeves 288. The shimming action of wedge W may be precisely controlled because the alignment is maintained and therefore set-up and operation of die means H is much improved.

While this invention as been described as having a preferred design, it is understood that it is capable of further modifications, uses, and/or adaptations of the invention following in general the principle of the invention and including such departures from the present disclosure as come within known or customary practice in the art to which the invention pertains, as may be applied to the central features hereinbefore set forth, and fall within the scope of the invention of the limits of the appended claims.

What I claim is:

1. An alignment mechanism for punch presses and the like, comprising:

(a) a base having an upper support surface;

(b) said upper support surface having a plurality of load oriented spaced shaped recesses;

(c) a base alignment sleeve positioned in each of said recesses and conforming thereto and extending upwardly above said upper support surface;

(d) a frame positioned on said upper support surface and having a portion extending upwardly therefrom;

(e) said frame having a first set of a plurality of load oriented spaced shaped recesses cooperating with said plurality of base recesses and adapted for receiving said alignment sleeves in said first set of recesses and for thereby aligning said frame with said base;

(f) said upwardly extending portion of said frame having an uppermost surface;

(g) said uppermost surface having a second set of a plurality of load oriented spaced shaped recesses;

(h) a crown alignment sleeve positioned in each recess of said second set of recesses and conforming thereto and extending upwardly above said uppermost surface;

(i) a crown positioned on and secured to said uppermost surface;

(j) said crown having a plurality of load oriented spaced shaped recesses cooperating with said second set of recesses and adapted for receiving said alignment sleeves of said second set of recesses in said crown recesses and for thereby aligning said crown with said frame;

(k) said frame having an upper end and a lower end;

(l) die means associated with said lower end;

(m) longitudinally displaceable die adjustment means associated with said upper end;

(n) laterally displaceable wedge means slideably bearing on said die adjustment means for longitudinally displacing said die means when said wedge means is laterally displaced;

(o) drive means associated with said crown and connected to said wedge means for laterally displacing said wedge means;

(p) a pair of spaced parallel opposed gib means fastened to said crown adjacent said frame upper end and extending below said uppermost surface; and, (q) said wedge means having a pair of opposed shoulders engaged with said gib means and adapted for being guided thereby during lateral displacement.

2. An alignment mechanism as in claim 1, wherein:

(a) said first set and said second set of recesses being co-axial.

3. An alignment mechanism as in claim 2, wherein:

(a) said base recesses being cylindrically shaped and having a pre-determined diameter; and, (b) said first set of recesses being cylindrically shaped and having a pre-determined diameter.

4. An alignment mechanism as in claim 3, wherein:

(a) said base alignment sleeves being generally cylindrically shaped and having upper and lower ends;

(b) said lower ends of said base alignment sleeves having an external diameter substantially equal to said base recesses diameter to substantially span said recesses; and, (c) said upper ends of said base alignment sleeves having an external diameter substantially equal to said first set of recesses diameter to substantially span said recesses.

5. An alignment mechanism as in claim 4, wherein:

(a) said pre-determined diameter of said base recesses being equal to said pre-determined diameter of said first set of said recesses.

6. An alignment mechanism as in claim 5, wherein:
(a) said base alignment sleeves being hollow and having a pre-determined internal diameter; and,
(b) said base alignment sleeves external diameter being substantially greater than said internal diameter.

7. An alignment mechanism as in claim 6, wherein:
(a) said base having an upper peripheral edge;
(b) said frame having a lower peripheral edge;
(c) said base recesses and said first set of recesses each being four in number;
(d) said base recesses being located at substantially said upper peripheral edge; and,
(e) said first set of recesses being located at substantially said frame lower peripheral edge.

8. An alignment mechanism as in claim 7, wherein:
(a) said base being generally rectangularly shaped; and,
(b) said base recesses being located generally at each corner of said base.

9. An alignment mechanism as in claim 8, further comprising:
(a) said second set of recess being cylindrically shaped and having a pre-determined diameter; and,
(b) said crown recesses being cylindrically shaped and having a pre-determined diameter.

10. An alignment mechanism as in claim 9, wherein:
(a) said crown alignment sleeves being generally cylindrically shaped and having upper and lower ends;
(b) said lower ends of said crown alignment sleeves having an external diameter substantially equal to said frame second set of recesses diameter to substantially span said recesses; and,
(c) said upper ends of said crown alignment sleeves having an external diameter substantially equal to said crown recesses diameter to substantially span said recesses.

11. An alignment mechanism as in claim 10, wherein:
(a) said pre-determined diameter of said crown recesses being equal to said pre-determined diameter of said second set of recesses.

12. An alignment mechanism as in claim 11, wherein:
(a) said crown alignment sleeves being hollow and having a pre-determined internal diameter; and,
(b) said crown alignment sleeves external diameter being substantially greater than said internal diameter.

13. An alignment mechanism as in claim 11, wherein:
(a) said frame having an upper peripheral edge;
(b) said crown having a lower peripheral edge;
(c) said crown recesses and said second set of recesses each being four in numbers;
(d) said crown recesses being located at substantially said crown lower peripheral edge; and,
(e) said second set of recesses being located at substantially said frame upper peripheral edge.

14. An alignment mechanism as in claim 13, wherein:
(a) said frame being generally rectangularly shaped; and,
(b) said second set of recesses being located generally at each corner of said frame upper peripheral edge.

15. An alignment mechanism as in claim 14, further comprising:
(a) said crown having an upper surface and a lower surface;
(b) said crown recesses being associated with said crown lower surface;
(c) said crown upper surface having a plurality of apertures co-axial with said crown recesses;
(d) rod means positioned in each of said base recesses and extending upwardly therethrough through said first set and said second set of recesses and said crown recesses and said crown apertures and said rod means having an upper end and a lower end;
(e) first securing means adjacent said base recesses fastened to said rod means lower end; and,
(f) second securing means adjacent said crown upper surface and fastened to said rod means upper end for maintaining positive positioning of said frame on said base and said crown on said frame.

16. An alignment mechanism as in claim 15, wherein:
(a) said rod means upper ends and lower ends being threaded;
(b) said first and said second securing means including nut means; and,
(c) said nut means being sized larger than said based recesses and said crown apertures.

17. An alignment mechanism as in claim 4, further comprising:
(a) said alignment sleeves each having upper and lower tapered edges for positioning said sleeves and said recesses.

18. An alignment mechanism as in claim 1, wherein:
(a) said drive means including motor means having a rotatable shaft extending therefrom substantially adjacent said wedge means;
(b) a laterally extending threaded insert in said wedge means coincident with and adjacent to said rotatable shaft;
(c) said rotatable shaft having a threaded portion for engaging said threaded insert; and,
(d) retaining means associated with said rotatable shaft for preventing lateral displacement of said rotatable shaft whereby rotation of said rotatable shaft causes lateral displacement of said wedge means and thereby longitudinal displacement of said die adjustment means.

19. An alignment mechanism as in claim 18, wherein:
(a) said wedge means adapted for longitudinally displacing said die means substantially 0.50 inches.

20. An alignment mechanism as in claim 18, further comprising:
(a) said gib means being associated with said crown lower surface;
(b) a plurality of apertures in said crown lower surface;
(c) a plurality of threaded apertures in said frame upper end co-axial with said crown apertures;
(d) slot means in said wedge means cooperating with said crown apertures and said frame apertures; and,
(e) stud means engaging said frame threaded apertures and extending upwardly through said slot means and through said crown apertures.

21. An alignment mechanism as in claim 18, further comprising:
(a) a plurality of apertures in said crown upper surface co-axial with said crown lower surface apertures;
(b) said stud means extending upwardly through said upper surface apertures;

(c) spring means annularly mounted to said stud means and spanning said stud means from said crown upper surface to said crown lower surface; and, (d) nut means securing said spring means to said stud means whereby said stud means and said spring act as shock absorbers.

22. An alignment mechanism as in claim 19, wherein:

(a) said stud means being two in number.

* * * * *